United States Patent [19]

Saunders

[11] 3,965,613

[45] June 29, 1976

[54] MAGNETIC TOY

[76] Inventor: Jack L. Saunders, S.C. Rte. Box 78, West Plains, Mo. 65775

[22] Filed: Feb. 12, 1975

[21] Appl. No.: 549,373

[52] U.S. Cl. ..... 46/238; 46/206

[51] Int. Cl.[2] ..... A63H 33/26

[58] Field of Search ..... 46/206, 237, 238; 294/65.5

[56] References Cited

UNITED STATES PATENTS

| | | | |
|---|---|---|---|
| 2,540,216 | 2/1951 | Quinby | 46/238 |
| 2,842,896 | 7/1958 | Sire | 46/238 |
| 3,582,123 | 6/1971 | Kyser | 294/65.5 |
| 3,711,991 | 1/1973 | Orfei | 46/238 |

*Primary Examiner*—Louis G. Mancene
*Assistant Examiner*—Robert F. Cutting
*Attorney, Agent, or Firm*—Charles B. Haverstock

[57] ABSTRACT

A magnetically controlled toy including a toy vehicle with magnetic means located therein and means to manipulate and guide the vehicle including a control member or wand which includes magnetic means that cooperate with the magnet means in the vehicle to produce magnetic coupling force therebetween.

7 Claims, 3 Drawing Figures

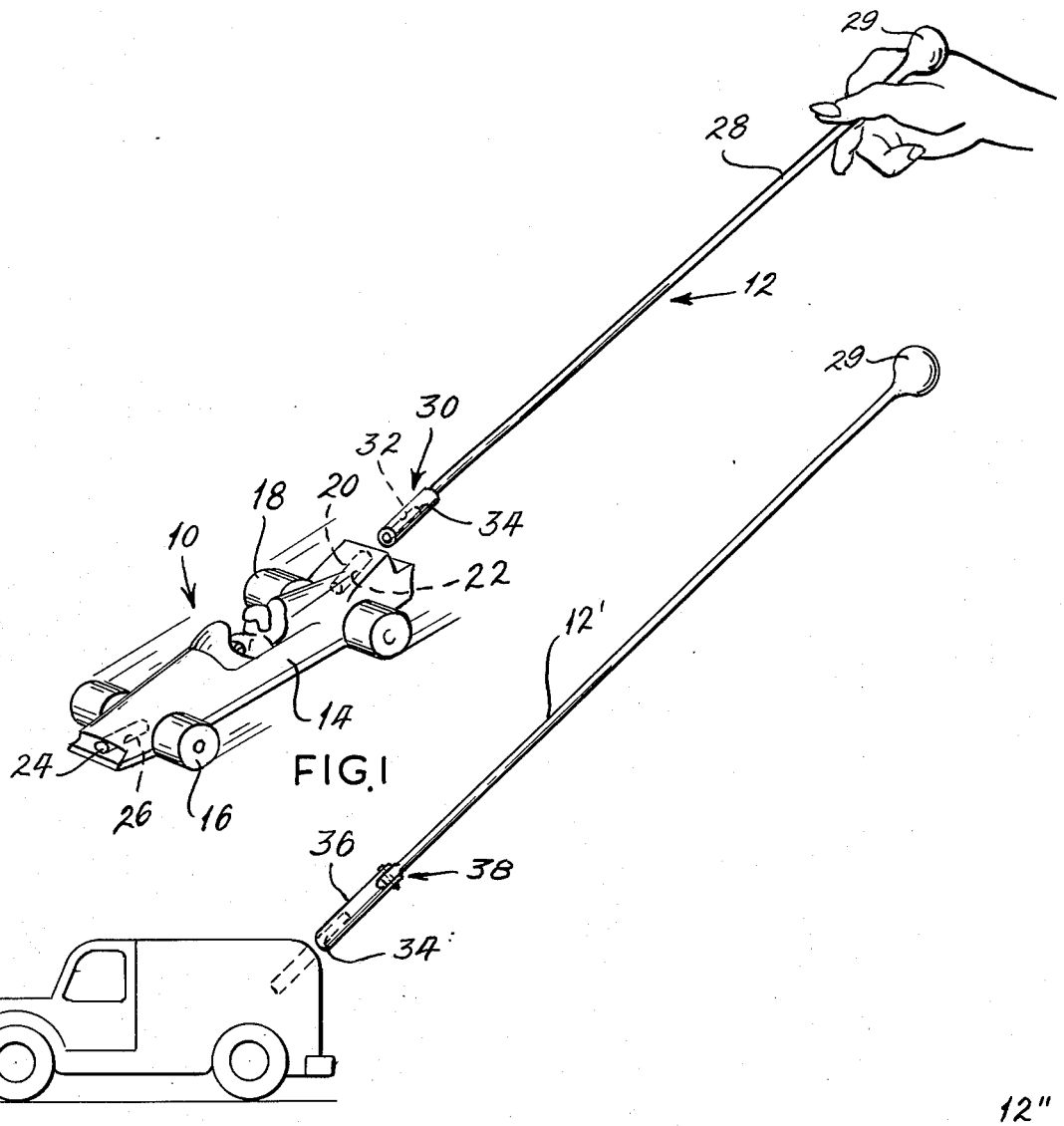
FIG.1
FIG.2
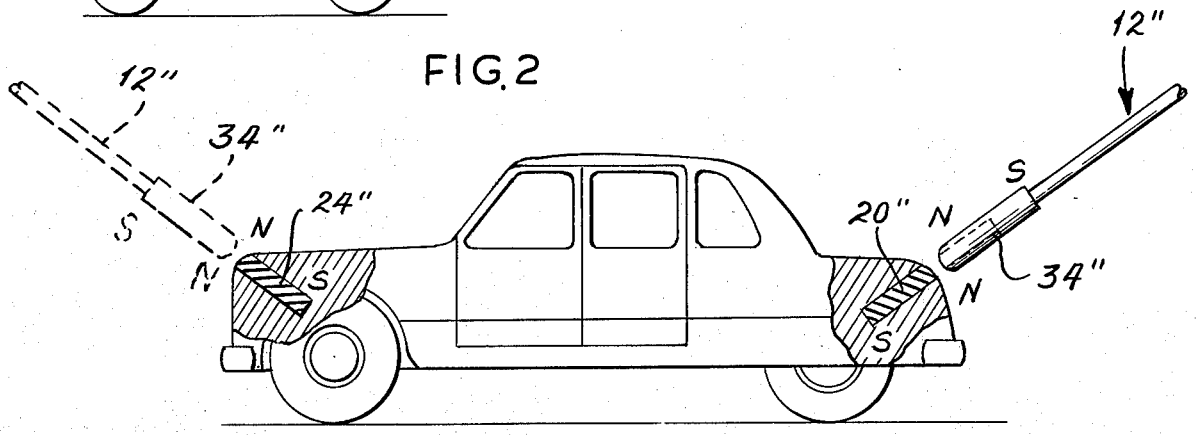
FIG.3

MAGNETIC TOY

There have been many toys which include magnetic means, a typical example of which is disclosed in Sire U.S. Pat. No. 2,842,896. The Sire patent shows a one-wheel vehicle that has magnetic means associated with the wheel portion in such a way that the magnetic coupling is in a direction that is parallel to the axis of the wheel. The wheeled vehicle in the patented construction is caused to move in response to movements of a control stick or wand which also contains a magnet which is positioned during operation in such a way that the axis of the magnet in the wand which is normal to the wand itself is substantially parallel to the axis of the magnet associated with the vehicle. The present device is substantially different in structure from the Sire device, and the manner in which it is operated and used is also different and requires considerably more skill and dexterity to operate and to guide than the Sire device. The present toy also can be used in competition as well as non-competitively which is different from prior art devices.

Other magnetic toys have also been devised and some have included portions which move in response to movements of a wand or other operator member. However, the known devices which include magnetic means for the most part have required a fairly reliable magnetic coupling force usually a positive coupling force between members and in the known devices the magnetic coupling has been relatively strong and easily and precisely controlled and does not normally vary substantially during operation. In view of this the operator of the known devices usually does not have difficulty maintaining the magnetic coupling, and the objective of such devices is one of guiding a member in some manner while the member is magnetically coupled to the guide means. The present device, on the other hand, is much more difficult to operate than known devices because not only will the magnetic coupling vary but the vehicle or member being moved and guided may also be able to change direction as it is being moved thereby making it much more difficult to guide and to control.

It is therefore a main object of the present invention to provide a toy construction which requires considerable skill and dexterity in its operation.

Another object is to provide novel means including magnetic coupling means to control and guide an object.

Another object is to control and guide an object using magnetically opposing means to produce the driving force.

Another object is to maximize a magnetic repulsive force used to move and guide an object such as a toy vehicle.

Another object is to provide a toy which can be made to be extremely simple to operate as well as relatively difficult to operate and control.

Another object is to provide a toy which is fun to use and can be used competitively as well as noncompetitively.

Another object is to provide a toy which is relatively inexpensive to manufacture and package and which is safe to use even when used by relatively young children.

Another object is to provide a toy which can be used to amuse as well as to develop skill and coordination.

Another object is to provide a toy which is relatively simple and inexpensive to make.

These and other objects and advantages of the present invention will become apparent after considering the following detailed specification which covers several preferred embodiments thereof in conjunction with the accompanying drawing, wherein like numerals refer to like parts throughout and in which:

FIG. 1 is a perspective view showing a toy vehicle being guided by a wand both of which are constructed according to the teachings of the present invention;

FIG. 2 is a side view similar to FIG. 1 showing another embodiment of the wand and of a vehicle for use therewith; and, FIG. 3 is an enlarged side elevational view partly in section showing another embodiment of the subject toy including a wand that is shown in solid outline being used to guide the vehicle from the rear and showing the same wand in dotted outline being used to guide the vehicle from the front.

Referring to the drawing more particularly by reference number, number 10 refers to a toy vehicle, shown as being a racer toy, and the reference numeral 12 refers to a wand which is used to propel and guide the vehicle. The vehicle 10 includes a body 14, a pair of front wheels 16, and a pair or rear wheels 18. Any toy vehicle can be used for the member 10 without changing the nature of the invention and the selection of a racer to illustrate the invention is not intended as a limitation thereof.

Of particular importance to the present invention is the provision on the vehicle 10 of means for mounting or locating a magnet 20. In FIG. 1 the magnet 20 is shown located in a pocket or compartment 22 near the rear end of the vehicle. A second magnet 24 may optionally be mounted in a similar compartment or pocket 26 located near the front end of the vehicle. The magnets 20 and 24 are preferably elongated magnets which have north pole ends (N) and south pole ends (S) and they are mounted on the vehicle so that one of the ends extends to adjacent the surface of the vehicle and the opposite magnet end is positioned at the opposite end of the compartments 22 and 26, respectively, in which they are positioned. Various means can be provided for forming the compartments in which the magnets are positioned including, if the vehicle 10 is constructed of plastic, a compartment molded into the plastic during formation. If the vehicle is formed of another material such as wood, then it may be necessary to drill a hole or holes in the vehicle to accommodate the magnet. The magnets can also be glued or otherwise attached in place. The angle at which the magnets 20 and 24 extend into the vehicle is not critical to the operation although it has been found that if the magnets are positioned more or less as shown in the drawing that they will provide the best results for reasons that will become apparent hereinafter.

The wand 12 as shown in FIG. 1 is an elongated rod member which preferably is also constructed of some inexpensive substance such as plastic or wood. One end of the wand 12 at 28 is the end that is held by the operator and used to manipulate the wand during operation of the toy. The end 28 may have an enlargement such as enlargement 29 formed thereon to minimize the possibility for injury especially when it is being used by small children. The entire wand 12 should also be made as smooth and free of sharp corners or sharp edges as possible for the same reason. The opposite end of the wand at 30 in the construction shown in FIG. 1 has a recess 32 which receives a magnet member 34 with the magnet positioned in the recess 32 so that one of the poles of the magnet 34 is adjacent to or forms at least a part of one end of the wand and the opposite magnet pole is positioned at the closed end at the recess 32.

It is preferred that the magnet 34 in the end of the wand be oriented so that the exposed or projecting pole has opposite polarity to the exposed magnet pole of the magnet 20 located at the rear end of the vehicle 10. This is so that when the wand is moved to a position adjacent to the rear end of the vehicle 10 as shown, two opposing magnetic poles will be brought into close proximity and this will cause the vehicle to move forwardly due to the repelling force of the magnets 34 and 20. The same is so of the optional magnet 24 located at the front end of the vehicle. The wand 12 is controlled by moving it while keeping the opposed magnets in close proximity so there is a continuous forward force exerted on the vehicle to move it. Depending upon the nature and size of the vehicle and the force applied in this manner the vehicle will advance forwardly on the surface on which it is located. Also depending on the construction of the vehicle and the surface it is moving over, there may be a tendency for the vehicle to turn to the right or left. This tendency may make it relatively difficult to control and guide the vehicle along some desired course and increases the skill and dexterity required. This is especially important to the enjoyment where several people are in competition to move their vehicles over a given course or to a finish line. The ability to be able to accurately control and guide the vehicle therefore depends upon many variables including the relative strengths of the magnets, the ability to keep the magnets in proper relationship and the tendency of the vehicle to want to turn. These variables add to the fun and skill required.

FIG. 2 shows a modified embodiment on the subject device wherein the magnet 34' is mounted on a pivoted or hinged end portion 36 of the wand 12' by hinge means 38. This makes it even more difficult for the operator to control and guide the vehicle because the wand magnet 34' is also able to move relative to the wand and the wand must therefore be more carefully controlled. For example, if the wand is held in one direction with the pivot means horizontal or nearly horizontal the pivoted end portion 36 and the magnet 34' will swing downwardly or downwardly and sidewardly thereby making it more difficult to maintain the opposed magnet ends in their best operating positions to exert the maximum force for advancing the vehicle. On the other hand, if the wand 12' is held so that the pivot is vertical or nearly vertical, the magnet will not be able to fall but it may be difficult to maintain it in the best possible position relative to the magnet on the vehicle. This increases the difficulty of operation. The magnet on the end of the wand might also be mounted on universally movable means such as on a ball joint but this is usually not desired and adds unnecessarily to the cost.

FIG. 3 shows a vehicle which has two magnets, one mounted in the front end (24'') and the other (20'') mounted at the rear end. Both of the magnets 20'' and 24'' are mounted in a manner similar to that already described with one end of the magnet 20'' extending to adjacent the rear surface of the vehicle and one end of the magnet 24'' similarly mounted but extending to adjacent the front end of the vehicle. This means that the wand 12'' can be used either to push guide the vehicle forwardly in the manner already described or it can be used to push the vehicle rearwardly by magnetically coupling the magnet 34'' on the wand 12'' to the magnet 24'' at the front end of the vehicle. This embodiment has the same advantages and characteristics as the embodiment already described but in addition may have certain appeal especially where it may be desirable to be able to move the vehicle in both directions for some reasons such as to return the vehicle to some starting point or to move the vehicle to a better position for some reason.

Thus there has been shown and described a novel toy construction which fulfills all of the objects and advantages sought therefor. It will be apparent to those skilled in the art, however, that many changes, modifications, variations and other uses and applications of the subject device are possible, and all such changes, modifications, variations and other uses which do not depart from the spirit and scope of the invention are deemed to be covered by the invention which is limited only by the claims which follow.

What is claimed is:

1. A magnetically operated toy comprising a wheeled vehicle having a body with front and rear ends, magnetic means on the vehicle body adjacent to one of said body ends, said magnetic means having opposite end portions respectively forming north and south magnetic poles and being fixedly positioned with respect to said vehicle body, the lowest point of said magnetic means being higher than the lowest point of said vehicle, one of the magnetic poles of said magnetic means being oriented essentially forwardly of the other magnetic pole on said vehicle body, and means to manipulate the vehicle by moving it over a surface including a rod-shaped operator member having a first end portion to be held by the operator and an opposite end portion having magnetic means associated therewith for cooperating magnetically with a magnetic means on the vehicle so that when the magnetic means on the rod and the magnetic means on the vehicle cooperate and the rod is moved the vehicle will move on the surface on which it is positioned, the magnetic means associated with the vehicle being further oriented such that when the vehicle is in operative position on a surface the axis of said magnetic means intersects a horizontal plane at an elevational angle.

2. The magnetically operated toy defined in claim 1 wherein the magnetic means on the vehicle and the magnetic means on the rod are magnetically oriented to oppose each other so that a pushing action is produced therebetween.

3. The magnetically operated toy defined in claim 1 wherein the magnetic means on the vehicle and the magnetic means on the rod are magnetically oriented to attract each other so that the magnetic coupling between the rod and the vehicle will cause the vehicle to move in concert with the rod.

4. The magnetically operated toy defined in claim 1 wherein similar magnetic means are mounted adjacent opposite ends of the vehicle.

5. The magnetically operated toy defined in claim 1 including means for hingedly connecting the magnetic means to the said opposite rod end portion, said connector means allowing some relatively free angular movement of said magnetic means with respect to the operator member.

6. The magnetically operated toy defined in claim 1 wherein the vehicle body has front and rear wheels mounted thereon, and a cavity formed in the body adjacent one end in which the magnetic means is positioned.

7. The magnetically operated toy defined in claim 1 wherein the axis of the magnetic means associated with the operator member is substantially linearly aligned with the longitudinal axis of said operator member.

* * * * *